United States Patent [19]

Daugherty

[11] Patent Number: 4,604,952

[45] Date of Patent: Aug. 12, 1986

[54] QUICK DRYING FOUNTAIN SOLUTIONS

[75] Inventor: John W. Daugherty, Fairlawn, N.J.

[73] Assignee: Inmont Corporation, Clifton, N.J.

[21] Appl. No.: 728,641

[22] Filed: Jun. 14, 1985

Related U.S. Application Data

[62] Division of Ser. No. 610,722, May 16, 1984.

[51] Int. Cl.[4] ..... B41M 1/06

[52] U.S. Cl. ..... 101/451; 106/2

[58] Field of Search ..... 101/451, 456; 106/2

[56] References Cited

U.S. PATENT DOCUMENTS 3,619,217 11/1971 West ..... 106/2

*Primary Examiner*—Lorenzo B. Hayes

*Attorney, Agent, or Firm*—Emil Richard Skula

[57] ABSTRACT

Water based fountain solutions for use in lithographic printing. The fountain solutions contain sufficient hydrogen peroxide to cause lithographic inks to dry more quickly. Typically the fountain solutions will contain about 0.005 wt. % to about 5.0 wt. % of hydrogen peroxide. The hydrogen peroxide containing fountain solutions are typically manufactured as concentrates which are diluted with water at the printing sites to form the proper strength fountain solutions required for printing. The hydrogen peroxide containing fountain solutions are used in conventional lithographic printing processes.

6 Claims, No Drawings

QUICK DRYING FOUNTAIN SOLUTIONS

This is a division of application Ser. No. 610,722 filed on May 16, 1984.

TECHNICAL FIELD

The field of art to which this invention pertains is lithographic printing and, more specifically, fountain solutions for use in lithographic printing.

BACKGROUND ART

The conventional offset lithographic printing processes employ planographic plates which transfer ink to a blanket roll which then transfers the ink to a substrate thereby forming the printed images. The plates are referred to as planographic since the image and non-image areas are in the same plane. The plates are constructed so that with proper treatment the image areas are rendered hydrophobic and oleophilic and are thereby receptive to inks. The non-image areas are hydrophilic and correspondingly water receptive. In order to maintain the hydrophobicity of the non-image areas, and thereby prevent ink from accumulating on these non-image areas, it is necessary to continuously treat the plate with a water based fountain solution. This is commonly referred to as desensitizing the plate. The water based fountain solution is typically applied with a separate roll prior to inking the plate, or the ink and fountain solution can be applied simultaneously as is typical of the Dahlgren type systems.

A desirable printing ink for use in a lithographic process is one which will have, in addition to other conventional properties, the ability to dry rapidly after being printed on a substrate. Failure of the printed ink to dry rapidly results in several problems such as decreased efficiency of the printing process due to slower press runs. In addition, failure of the ink to dry rapidly results in set off. Set off occurs when printed ink which is not dry adheres to the back of a printed substrate placed on top of it during the stacking of printed substrate as it comes off the presses. This results in a diminution of the appearance of both the printed sides and the non-printed sides of the substrates in a stack.

Due to the nature of the lithographic printing process, lithographic inks are characterized as being oily or greasy since the lithographic inks must be immiscible with water. Lithographic inks typically contain drying oils and drying oil modified alkyds as vehicles. A vehicle is the fluid component of a printing ink which serves as the dispersing and carrying medium for the pigment particles. The vehicle is responsible for the rheological properties of the inks, and the vehicle binds pigment to a printed substrate. The drying properties of lithographic inks are attributable to the chemical characteristics and Drying oils may be derived from mineral oils, vegetable oils, animal oils or synthetic oils. The most commonly used drying oils are vegetable oils such as linseed oil, chinawood oil, oiticica oil, perilla oil, soya bean oil, etc. The drying oils are characterized by their ability to absorb atmospheric oxygen and form a film. Drying oils generally contain large quantities of glycerides of unsaturated fatty acids such as linoleic acid and linolenic acid, etc.

Lithographic printing inks dry by the oxidation of the drying oils or drying oil modified alkyds contained in these inks. Oxidation of these drying oils is thought to result in a polymeric network thereby producing a dry printed ink. Normally, the unassisted drying process takes days. It is known in the art to include substances in the formulation of these inks to speed up the drying or "setting" process. These substances, conventionally known as driers, increase the rate of transformation of the ink from the liquid phase to the solid phase. Driers, which are actually catalysts, speed up the oxidation rate so that the drying process is typically complete within several hours. Conventional driers used in lithographic inks are typically the metallic soaps of organic acids and inorganic salts. Metallic driers are usually classified as liquid driers or paste driers. The liquid driers comprise oil soluble soaps, while the paste driers comprise dispersions of inorganic salts in oils. The liquid driers are prepared by the reaction of metal oxides or metal salts with saponified organic acids. Typical of the metal driers are cobalt, lead, manganese, cerium, zirconium, lithium, calcium, zinc and iron. The paste driers are typically prepared by grinding lead and manganese organic salts, such as lead acetate and manganese borate, into linseed oil varnishes. Inks containing paste driers dry more slowly than inks containing liquid driers. Different metallic driers have different effects on the drying characteristics of a lithographic ink. For example, cobalt driers catalyze surface drying of lithographic inks, while lead driers catalyze through drying of lithographic inks.

The amount of drier which can be included in a printing ink is limited to an optimum amount. Above this optimum, several problems are encountered resulting in unacceptable ink characteristics such as decreased shelf storage life, poor printing characteristics due to premature drying, and continually decreasing aesthetic appearance of the printed ink over time due to continuing oxidation after drying caused by the high concentration of drier.

As stated above, in order to prevent these inks from accumulating in the non-image areas, it is necessary to continually treat the plates with fountain solution. Although plain tap water can be used as a fountain solution, it is known in the art to include additives to enhance or improve the printing characteristics. It is known to include low boiling point alcohols such as isopropanol and ethanol, and various surfactants to reduce the surface tension of the solution thereby producing better wetting of the plate. It is also known to add acids and/or buffers to achieve and maintain a certain pH range. Glycerine is typically added to fountain solutions to act as a humectant and lubricant. Acid containing fountain solutions typically contain sufficient quantities of gum arabic to protect the plate from excessive etching. Bactericides and algicides are added to control microbiogical growth. Typically these multicomponent fountain solutions are sold by the manufacturer as a concentrate. The fountain solutions are prepared at the printing site by diluting the fountain solution concentrates with water.

The fountain solution can be very important during a press run with regard to improving the lithographic printing characteristics by eliminating or reducing process problems such as greasing or scumming, tinting, stripping, poor ink transfer and piling. An improperly formulated fountain solution will result in an increase in the drying time of the printed ink.

Driers have been included in fountain solutions to improve the drying time of the printed ink. For example, cobalt acetate has been included in the formulation of fountain solutions. Because of the nature of the lithographic printing process, a certain amount of fountain solution will be emulsified in the printed ink thereby resulting in a transfer of the cobalt acetate, a drier, in the fountain solution to the printed ink. The resultant increased concentration of drier in the printed ink produces a decrease in the drying time of the ink. There are several problems associated with the use of driers such as cobalt acetate in fountain solutions, including erratic drying time of the printed ink over the press run. This is caused by a typically increased concentration of the drier in the fountain solution over time during a press run resulting in an increased concentration of the drier in the ink and a consequent variable reduction in drying time. In addition to the drying time of the printed ink being erratic, the increased concentration of drier causes premature drying of ink, typically resulting in a build-up of ink on the press rollers which will ultimately result in a decreased quality of the printed image.

Accordingly, what is needed in the art is a means for reducing the drying time of printing inks without increasing the concentration of driers in the inks.

DISCLOSURE OF THE INVENTION

It has been found that the inclusion of small amounts of hydrogen peroxide in a water based lithographic fountain solution surprisingly and unexpectedly reduces the drying times of inks by acting as a drying stimulator without having detrimental effects on the lithographic properties. The water based fountain solutions of this invention contain sufficient amounts of hydrogen peroxide such that when used in a lithographic printing process, the drying time of the lithographic ink or inks will be decreased. The fountain solutions of this invention will typically contain from about 0.005 wt. % to about 5.0 wt. % of hydrogen peroxide and more typically from about 0.1 wt. % to about 3.0 wt. % of hydrogen peroxide.

Typically, the fountain solutions of this invention are manufactured as a water dilutable concentrate containing about 0.50 wt. % to about 8.0 wt. % of hydrogen peroxide and more typically about 1.0 wt. % to about 6.0 wt. % of hydrogen peroxide.

Another aspect of this invention is the method of using the water based hydrogen peroxide containing fountain solutions of the present invention in a conventional lithographic printing process to improve the drying time of the printed lithographic ink or inks wherein the fountain solution contains about 0.005 wt. % to about 5.0 wt. % of hydrogen peroxide.

The foregoing, and other features and advantages of the present invention will become more apparent from the following description.

DESCRIPTION OF PREFERRED EMBODIMENTS

The inclusion of hydrogen peroxide in the fountain solutions and fountain solution concentrates of this invention provides a means for reducing the drying time of printed lithographic inks. Sufficient amounts of hydrogen peroxide are used in the fountain solutions and fountain solution concentrates of this invention so that during the conventional lithographic printing process, where there is some degree of mixing of fountain solution and lithographic inks, the concentration of hydrogen peroxide in the printed ink will be sufficient to improve the drying time of the printed inks without having detrimental effects on the lithographic properties. The hydrogen peroxide which will typically be used in the practice of this invention will be commercially available 3% hydrogen peroxide solution, U.S.P. 10. Typical of such 3% hydrogen peroxide solutions is $H_2O_2$ solution distributed by Drug Guild Distributors, Secaucus, N.J.

Hydrogen peroxide is typically manufactured and sold commercially as a 27.5% strength solution in water by companies such as FMC Corporation. Hydrogen peroxide purchased in this strength would be diluted with water for use as a component in the fountain solutions and concentrates of this invention. It should be noted that there are no shipping restrictions on solutions containing 8.0 wt. % or less of $H_2O_2$ per the *Chemical Dictionary,* 9th Ed., Hawley, G. G.

Typically, the fountain solution of this invention will contain about 0.005 wt. % to about 5.0 wt. % of hydrogen peroxide, more typically, about 0.01 wt. % to about 3.0 wt. % of hydrogen peroxide. A preferred embodiment contains about 0.6 wt. % of hydrogen peroxide.

Sufficient hydrogen peroxide will be incorporated into the fountain solution concentrates of this invention to produce, when diluted with water, fountain solutions having the previously described quantities of hydrogen peroxide.

The fountain solution concentrates of this invention typically contain about 0.50 wt. % to about 8.0 wt. % of hydrogen peroxide, more typically about 1.0 wt. % to about 6.0 wt. %. A preferred embodiment contains about 3.0 wt. %.

In addition to water, the fountain solutions of this invention may incorporate additional components which are conventionally incorporated into water based fountain solutions. For example, sufficient quantities of low boiling point alcohols, such as ethanol isopropanol, etc., or mixtures of low boiling point alcohols may be incorporated to reduce the surface tension of the fountain solution thereby permitting adequate wetting of the hydrophilic non-image areas of the plate. Sufficient amounts of surfactants such as ethoxylated alkyl phenols, ethoxylated aliphatic alcohols, sodium salts of organic phosphate esters, modified linear aliphatic polyethers, etc. may also be included in the fountain solutions to provide required wetting of the planographic plate by decreasing the surface tension of the fountain solution. Sufficient quantities of polyols such as glycerine are added to serve as a humectant. Sufficient quantities of buffer salts and acids are typically added to a fountain solution to maintain a given pH range throughout a press run. It is known that the pH of a fountain solution will affect the printing characteristics of a lithographic ink, including drying time. The preferred pH range depends upon several factors including the paper stock, ink formulation and local potable water. In the United States, a preferred pH for fountain solutions is about 3.0 to about 5.0. Buffer salts typically used are organic and inorganic salts such as sodium phosphate, sodium citrate, potassium phosphate, potassium citrate, magnesium sufate and ammonium phosphate, etc. Acids typically used are phosphoric acid and various organic and inorganic acids such as citric acid, tartaric acid, sulfuric acid, etc. Sufficient quantities of gum arabic are typically included in an acid based fountain solution to reduce excessive etching of the plate. The following commercially available fountain solution concentrates can be used in the practice of this invention: Rosos G7AV, Rosos Chemical Co., Lake Bluff, Ill.; Rycoline Blue Chip Combination, Rycoline Solvent Co., Chicago, Ill.; and, Wonderlene, Varn Products Corporation, Oakland, N.J.

While the fountain solutions of this invention are primarily water based, it would be appreciated by a person skilled in the art to use fountain solutions containing primarily solvents other than water (e.g., isopropanol) in combination with hydrogen peroxide if one were willing to accept the disadvantages associated with using such a solvent based system.

The fountain solutions of this invention are typically manufactured as concentrates and diluted at the printing site to form a fountain solution. Although, they can be manufactured and sold as ready to use fountain solutions. In order to manufacture the fountain solutions of this invention sufficient quantities of a hydrogen peroxide solution are blended into a fountain solution concentrate so that preferably upon dilution of the concentrate in water to form a fountain solution, there will be a sufficient quantity of hydrogen peroxide in the fountain solution to reduce the drying time of a printed ink. The hydrogen peroxide is typically blended into the concentrate with a conventional mixing means. It is preferred to use a slow speed mixer such as a Talboy TM mixer, etc. Typically from about 0.50 liquid ounces to about 63.0 liquid ounces of hydrogen peroxide solution will be mixed with one liquid ounce of fountain solution concentrate to form the fountain solution concentrates of this invention. Although the hydrogen peroxide is added in solutions of any concentration, it is typically added in a 3% solution (commonly available).

The fountain solutions of this invention may also be manufactured as ready to use fountain solutions, rather than concentrates. To manufacture ready to use fountain solutions, sufficient quantities of hydrogen peroxide solution, typically 3% $H_2O_2$ solution, are blended with a fountain solution using a conventional mixing means so that sufficient hydrogen peroxide is present to reduce the drying time of printed lithographic inks.

The fountain solution or fountain solution concentrate containing hydrogen peroxide is packaged in opaque or amber glass containers to prevent break down of the hydrogen peroxide in the product by light. In all other respects, the fountain solution concentrates of this invention are stored and handled in a similar manner to conventional fountain solution concentrates.

It is surprising and unexpected that a fountain solution comprising hydrogen peroxide when used in a lithographic printing process will reduce the drying time of printed lithographic inks, while not having detrimental effects on the lithographic properties. Lithographic inks generally contain an optimum level of driers such as cobalt soaps, etc. An upward variation from this level produces adverse effects such as premature drying, equipment fouling, long term oxidation and consequent diminishment in aesthetic appearance of the printed ink, etc. While not wanting to be limited to any theory it is believed that the hydrogen peroxide which is introduced into the ink via the fountain solutions of this invention does not act as a drier but as a drying stimulator. The drying oils such as linseed stand oil and drying oil modified alkyds, and other drying oils which are the primary vehicles in lithographic printing inks, dry chemically through an autoxidation process. It is believed that the hydrogen peroxide serves as a source of oxygen which propagates free radicals and also reacts at reactive sites to form hydroperoxides which decompose to form additional free radicals, further propagating the polymerization of the drying oils. This autoxidation process eventually produces, depending on the particular reaction kinetics, a three dimensional polymer and, correspondingly, a dry ink.

The use of the fountain solutions of this invention in a method of lithographic printing will result in a significant reduction in drying time of the printed ink, typically of up to or exceeding 50%. It is surprising and unexpected that the relatively small amounts of hydrogen peroxide contained in the fountain solutions and concentrates of this invention have such a substantial impact on drying time. The mechanisms of the actual printing processes to which this invention applies have been discussed in the background section.

The following examples are illustrative of the principles of practice of this invention although not limited thereto. Parts and percentages where used are parts and percentages by weight.

EXAMPLE 1

A standard quick set ink process blue having the following formula was used:

27.0%: alkyd drying oil
6.0%: cobalt drier
3.0%: polyethylene wax
15.0%: phthalo blue pigment
25.0%: resin
24.0%: aliphatic hydrocarbon oil Water was used as a control fountain solution, versus a dampening solution comprising 3% hydrogen peroxide solution. To a first sample of ink, 35% of water was added and mixed with a Talboy variable speed mixer. To the second sample, 35% of a U.S.P. 10 hydrogen peroxide solution (3%) was added and mixed in a similar manner. A 0.5 mil. film of each ink mixture was applied to glass using a #35 Precision Wet Film Applicator from Precison Gage & Tool Co. and checked for drying over a period of 8 hours by finger transfer. The finger transfer test is a standard test wherein a technician touches a finger to the ink and then touches an uncoated section of the glass. The glass is then checked for ink transfer which would indicate that the ink surface is still wet. The water containing ink had finger transfer after 8 hours, while the hydrogen peroxide containing ink had no finger transfer after 3 hours.

EXAMPLE 2

The same test procedure as described in Example 1 was repeated, except that a conventional fountain solution made by diluting a ROSOS 7AV-Combo fountain solution concentrate manufactured by Rosos Chemical Co. was used. The fountain solution concentrate was diluted with tap water in accordance with the manufacturers instructions to produce two fountain solutions having a pH of 3.1 and 4.5 respectively. 3% hydrogen peroxide solution was blended with each fountain solution. The following ratios of hydrogen peroxide (3% solution) to the fountain solutions were mixed and tested, 1:1, 1:3, 1:9, 1:49, and 1:99. All of the inks treated with hydrogen peroxide containing fountain solution (3.1 pH and 4.5 pH) demonstrated a decrease in drying time over the controls of about 50%. There was much less set off (offsetting) in the hydrogen peroxide treated inks.

EXAMPLE 3

Two samples of the process blue ink described in Example 1 were utilized. To the first sample of ink, 35% of a conventional fountain solution (ROSOS 7AV comb. at pH 4.0) was added and mixed with a Talboy variable speed mixer until uniformly emulsified. To the second sample, 35% of a 1:1 blend of the conventional fountain solution described above and a 3% hydrogen peroxide solution were mixed as sample 1. The two inks were printed on a Gallus proofing press with the following test results:

Setting: The ink containing hydrogen peroxide was slightly faster with much less offsetting.

Sutherland Rub Test: The hydrogen peroxide containing ink had better rub resistance.

Density: (standard reflection densitometer):

Standard ink—1.57

Ink containing $H_2O_2$—1.57

Gloss (60°):

Standard ink—44.2

Ink containing $H_2O_2$—45.1

EXAMPLE 4

The standard ink of example 1 was run on an A.B. Dick duplicator press (Model 320) using the following fountain solution compositions:

a. Straight 3% hydrogen peroxide solution.

b. A 1:1 blend of A.B. Dick fountain solution and 3% hydrogen peroxide solution.

c. A 3:1 blend of A.B. Dick fountain solution and 3% hydrogen peroxide solution.

One thousand impressions were run using each fountain solution. There were no detrimental effects observed with the hydrogen peroxide containing fountain solutions. The straight 3% hydrogen peroxide fountain solution demonstrated some pick-up of ink in the non-image areas of the plate after 500 copies.

EXAMPLE 5

The standard ink of example 1 was run on a Solna ATF 225 commercial sheet fed press. The fountain solution was a 1:1 blend of ROSOS 7AV Combo fountain solution and 3% hydrogen peroxide solution. Approximately 2,500 impressions were run with no detrimental effect. The printed ink displayed no set off (offsetting). No spray powdered was required. Spray powder is typically applied after the substrate is printed to reduce or eliminate set off (offsetting). The conventional spray powder typically used is corn starch. Spray powder has the disadvantage of making the printed substrate feel rough to the touch.

It is surprising that only a small percentage of hydrogen peroxide in the fountain solutions of this invention will produce the substantial decreases in ink drying times. It is surprising and unexpected that excessive build ups of hydrogen peroxide in the inks will not produce erratic drying results, thereby eliminating the previously mentioned disadvantages of using driers such as cobalt acetate in fountain solutions. In addition, the use of the fountain solutions of this invention has been found to not affect performance parameters such as gloss, printability and ink/water balance. In addition, the following performance parameters have been found to be enhanced by the use of the fountain solutions of this invention: rub resistance and through dry. Another advantage of this invention is that it may be possible to eliminate or reduce the amount of spray powder in the lithographic printing process.

The fountain solution concentrates and fountain solutions of this invention are relatively inexpensive to manufacture, can be used in the place of conventional fountain solutions, and are relatively stable and easy to store.

Although this invention has been shown and described with respect to the detailed embodiments thereof, it will be understood by those skilled in the art that various changes in form and detail thereof may be made without departing from the spirit and scope of the claimed invention.

I claim:

1. In a method of lithographic printing, comprising:

(a) transferring a water based fountain solution to a lithographic plate, (b) then transferring at least one lithographic ink to said plate, (c) transferring said ink from said plate to a blanket roll, and (d) then transferring said ink from said roll to a substrate thereby producing a printed image, wherein the improvement comprises the inclusion of about 0.005 wt. % to about 5.0 wt. % of hydrogen peroxide in the fountain solution for the purpose of quick drying, thereby producing a decrease in the drying time of the ink.

2. The method of claim 1 wherein the concentration of hydrogen peroxide in the fountain solution is about 0.1 wt. % to about 3.0 wt. %.

3. The method of claim 1 wherein the concentration of hydrogen peroxide in the fountain solution is about 0.6 wt. %.

4. In a method of lithographic printing, comprising:

(a) simultaneously transferring a water-based fountain solution and at least one lithographic ink to a lithographic plate, (b) then transferring said ink from said plate to a blanket roll, and (c) Then transferring said ink from said roll to a substrate, thereby producing a printed image, wherein the improvement comprises the inclusion of about 0.005 wt. % to about 5.0 wt. % of hydrogen peroxide in the fountain solution for the purpose of quick drying, thereby producing a decrease in the drying time of the ink.

5. The method of claim 4 wherein the concentration of hydrogen peroxide in the fountain solution is about 0.1 wt. % to about 3.0 wt. %.

6. The method of claim 4 wherein the concentration of hydrogen peroxide in the fountain solution is about 0.6 wt. %.

* * * * *